US005142888A

United States Patent [19]

Ling

[11] Patent Number: 5,142,888

[45] Date of Patent: Sep. 1, 1992

[54] ROTATABLY UNLOCKABLE COMBINATION LOCK HAVING REMOVABLE SHACKLE

[76] Inventor: Chong-Kuan Ling, c/o Sinox Co., Ltd., P.O. Box 96-156, Taipei, Taiwan

[21] Appl. No.: 721,940

[22] Filed: Jun. 27, 1991

[51] Int. Cl.[5] ..... E05B 37/02

[52] U.S. Cl. ..... 70/26; 70/312

[58] Field of Search ..... 70/24–26, 70/312, 304–305

[56] References Cited

U.S. PATENT DOCUMENTS 3,855,826 12/1974 Hori ..... 70/417
3,983,724 10/1976 Foote ..... 70/25
4,085,600 4/1978 Bindari ..... 70/211
4,354,365 10/1982 Mayer et al. ..... 70/312
4,615,191 10/1986 Granby ..... 70/26
4,621,509 11/1986 Mizumo ..... 70/26
4,885,923 12/1989 Nakai ..... 70/312
5,027,623 7/1991 Ling ..... 70/26

*Primary Examiner*—Renee S. Luebke
*Assistant Examiner*—D. Boucher

[57] ABSTRACT

A combination lock includes a locking member normally locking a U-shaped shackle lockably secured on a cylindrical casing, a rotating knob rotatably mounted in a lock body combinably secured with the cylindrical casing having a plurality of combination dials and sleeves rotatably mounted on the lock body, whereby upon a rotation of the dials to a predetermined opening combination on the lock body to unlock the rotating knob to allow a free rotation of the rotating knob to disengage the locking member from the shackle, the shackle will be unlocked and removed from the cylindrical casing easily.

3 Claims, 3 Drawing Sheets

ROTATABLY UNLOCKABLE COMBINATION LOCK HAVING REMOVABLE SHACKLE

BACKGROUND OF THE INVENTION

Mizuno disclosed a combination locking device having removable U-shaped retaining rod in his U.S. Pat. No. 4,621,509 which however may have the following drawbacks:

1. For removing the retaining rod 3 from the cylindrical body case 10, the knob 16 is retracted along the long hole 15 formed in between the retaining rod 3 and the combination lock 1 when the number rings 22 are rotated to their opening combination so as to unlock the retaining rod 3 by disengaging the retaining piece 6 from the retaining grooves 5 formed on the retaining rod 3. The knob 16 should be always pulled sidewardly towards the combination lock 1 bearing a spring force acted by the spring 27, causing an inconvenience for opening the lock.

2. The knob 16 is positioned between the retaining rod 3 and the combination lock 1 so that a retraction operation for unlocking the retaining rod 3 is narrowly limited by the U-shaped rod 3 and the lock 1, causing an inconvenient unlocking operation on an ergonomic point of view.

3. In order to provide a reciprocative stroke for the movement of the knob 16, the cylindrical body case 10 should have an enough length to thereby prolong a total length of the case 10 and the lock 1, increasing a handling or storage volume therefore.

4. There is not provided with any device for changing or resetting a new unlocking combination.

Mayer et al disclosed a permutation lock in their U.S. Pat. No. 4,354,365. For changing a new combination, the closing bolt 18 should be retracted outwardly to retard an inwardly radial movement of the shank 31 of locking pin 28 so that the inner rings 36 are secured against rotation for re-setting a new combination. However, the retraction of the bolt 18 should be done very carefully. Otherwise, if the recess 32 between every two lands 76 of the bolt 18 is meeting the shank 31, the pin 28 will not be retarded radially outwardly, allowing a coupled rotation of the two rings 36, 38 thereby influencing the operation for changing the combination.

The present inventor has found the drawbacks of the conventional combination locks and invented the present combination lock which can be rotatably unlocked quite conveniently.

SUMMARY OF THE INVENTION

The object of the present invention is to provide a combination lock including a locking member normally locking a U-shaped shackle lockably secured on a cylindrical casing, a rotating knob rotatably mounted in a lock body combinably secured with the cylindrical casing having a plurality of combination dials and sleeves rotatably mounted on the lock body, whereby upon a rotation of the dials to a predetermined opening combination on the lock body to unlock the rotating knob to allow a free rotation of the rotating knob to disengage the locking member from the shackle, the shackle will be unlocked and removed from the cylindrical casing easily.

DETAILED DESCRIPTION

Figure 1:
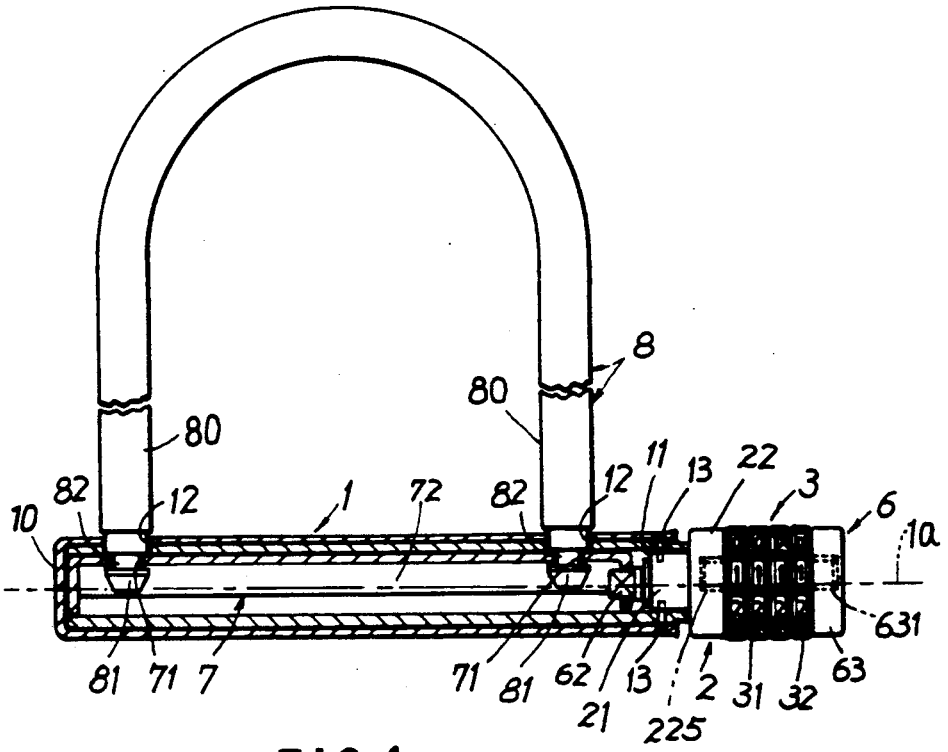
FIG. 1 is an illustration of the present invention.

As shown in the drawing figures, the present invention comprises: a hollow cylindrical casing 1, a lock body 2 secured to an opened end portion 11 of the casing 1, a plurality of dials 3 and sleeves 4 rotatably mounted on the lock body 2, a combination-changing means 5, a rotating knob 6 rotatably secured with the lock body 2, a locking member 7 secured with the knob 6 rotatably held in the cylindrical casing 1, and a shackle 8 generally U-shaped lockably secured with the cylindrical casing 1.

As shown in FIG. 1, the hollow cylindrical casing 1 includes two shackle holes 12 formed in the casing 1 for respectively inserting two leg members 80 of the shackle 8 through the two holes 12, a closed end portion 10 opposite to the open end portion 11, and at least a fixing pin 13 inserted in the open end portion 11 for combinably securing the lock body 2 with the casing 1.

The lock body 2 includes: a hollow spindle 21 defining a central hole 23 longitudinally formed through spindle 21, an inner cap 22 secured with the spindle 21 proximate the open end portion 11 of the casing 1, an outer cap 24 formed on an outer portion of the lock body 2 defining a shaft portion 20 between the inner cap 22 and the outer cap 24 for rotatably mounting the dials 3 and sleeves 4 on the shaft portion 20, a plurality of pin holes 25 longitudinally juxtapositionally formed in the hollow spindle 21 each the pin hole 25 perpendicular to a longitudinal axis 1*a* of the cylindrical casing 1 and the lock body 2 (both casing 1 and lock body 2 having a common axis of the longitudinal axis 1*a*), a plurality of pins 26 generally mushroom-shaped each pin 26 slidably held in each pin hole 25, a positioning ball 271 resiliently retained in a ball hole 27 formed through the spindle 21 having a ball spring 272 normally urging the ball 271 towards the axis 1*a* of the lock body 2.

The hollow spindle 21 is formed with a L-shaped groove 211 in a circumference surface of the spindle 21 for slidably fixing a protrusion 221 convexly formed on the inner cap 22 for fixing the inner cap 22 on the spindle 21.

Figure 6:
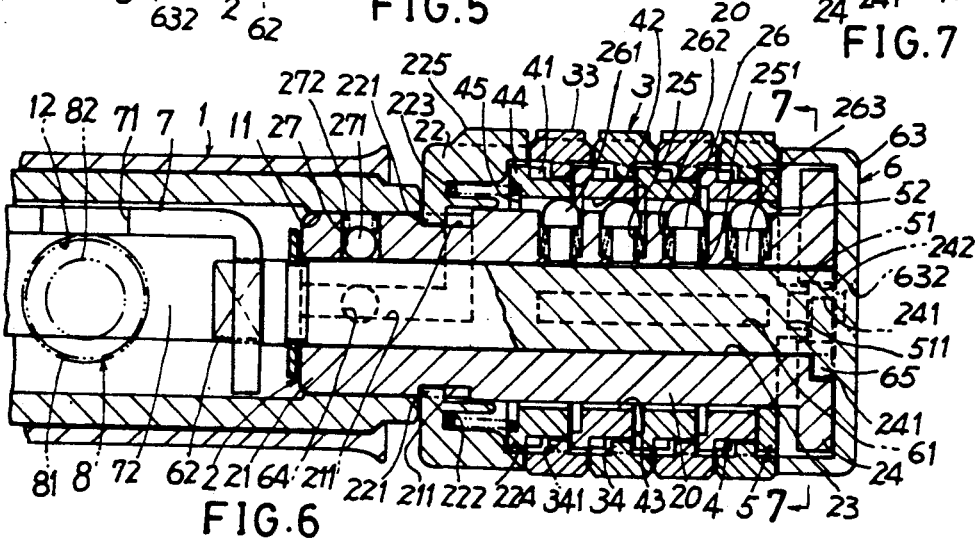
FIG. 6 is an illustration showing a combination changing operation of the present invention.

The inner cap 22 includes a shallow groove 224 annularly formed in an outer flange of the cap 22 for rotatably engaging an inner sleeve 4 as shown in FIG. 6, and a deep groove 222 recessed inwardly from the groove 224 for retaining a tensioning spring 223 in the deep groove 22, and a marking extension 225 formed on an upper outer surface of the cap 22 for pointing an opening combination of the dials 3.

Figure 5:
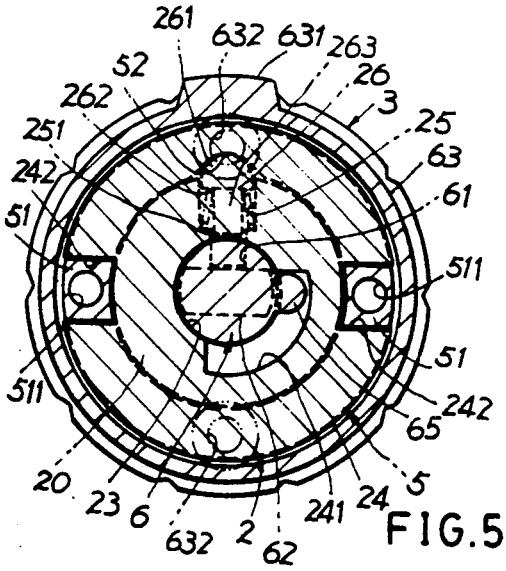
FIG. 5 is a cross sectional drawing of the present invention when viewed from 5—5 direction of FIG. 2.
Figure 7:
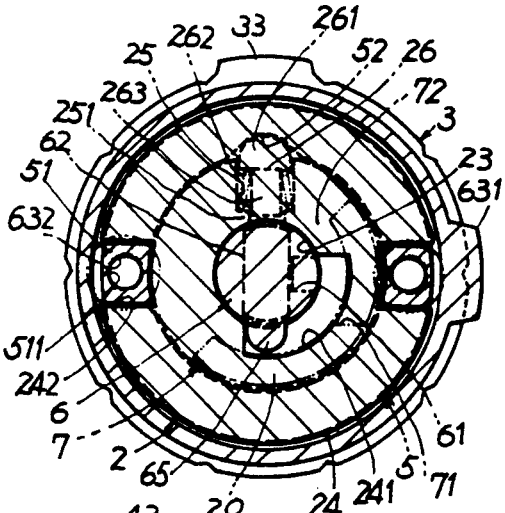
FIG. 7 is a cross sectional drawing of the present invention when viewed from 7—7 direction of FIG. 6.

The outer cap 24 is formed with an arcuate slot 241 in the cap 24 as shown in FIG. 5 circumferentially disposed around the central hole 23 of the spindle 21, and a positioning slot 242 formed in a side portion of the cap 24.

Each pin hole 25 is formed with a shoulder portion 251 on a lower edge portion of the pin hole 25 for retaining a pin spring 262 disposed around a shank portion 263 for normally urging an enlarged head portion 260 of the pin 26 upwardly.

Each dial 3 generally formed as a collar includes: a plurality of numbers 32 such as: 0, 1, 2,–9 annularly formed on an outer surface of the dial 3 with every two neighbouring numbers 32 separated by a notch 31 recessed in the outer surface, a convex protrusion 33 formed on a number such as the number "0" for touch feeling when rotating the dial 3 with respect to the marking extension 225 of the lock body 2, and an inner ring 34 formed on a central portion of an inside cylindrical surface of the dial 3 having a plurality of recesses 341 annularly recessed in the inner ring 34.

Each sleeve 4 includes: a plurality of protrusions 41 circumferentially formed on an outer cylindrical surface of the sleeve 4 engageable with the recesses 341 of the dial 3, a plurality of shallow recesses 43 corresponding to the numbers 32 of the dial 3 annularly formed in an inner ring 45 of the sleeve 4 defining a sleeve hole 40 rotatably engageable with the spindle 21 of the lock body 2, a deep recess 42 recessed in the inner ring 45 having a depth deeper than that of the shallow recess 43 having two sloping surfaces 421 formed on two opposite side portions of the recess 42 for slidably receiving the mushroom-shaped head portion 260 of the pin 26 as retained by the pin spring 262, and a flange 44 adjacent to the protrusions 41 engageable with the inner ring 34 of the dial 3.

Figure 2:
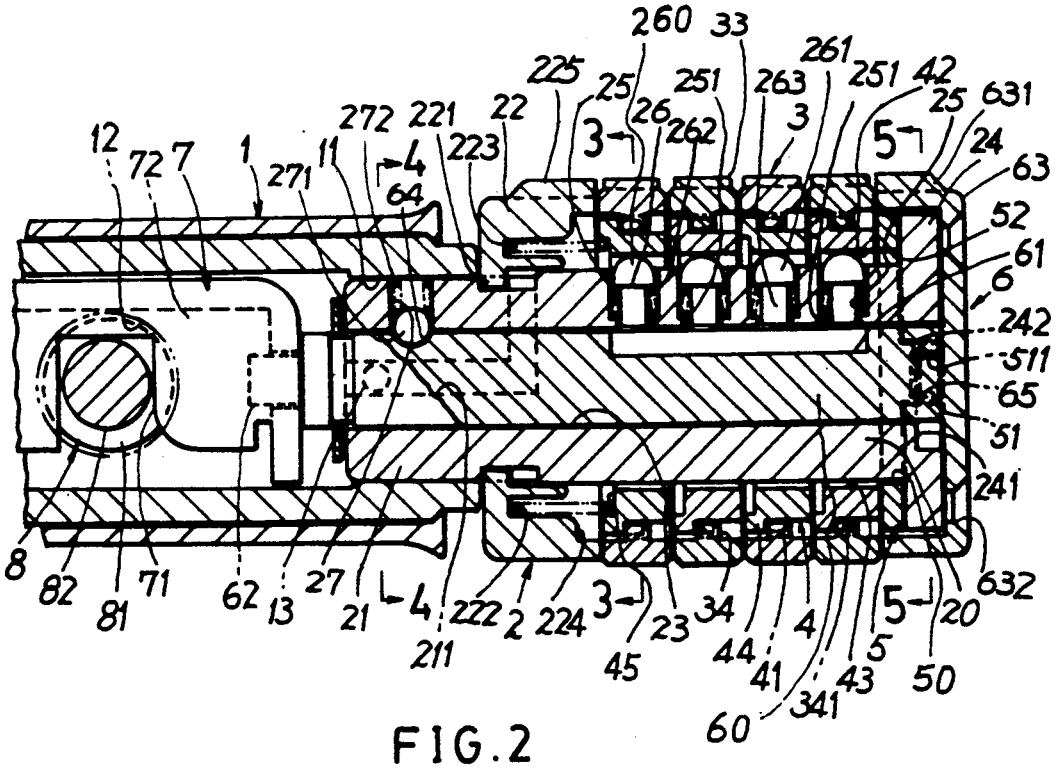
FIG. 2 is a top-view illustration showing an opened combination lock of the present invention.
Figure 3:
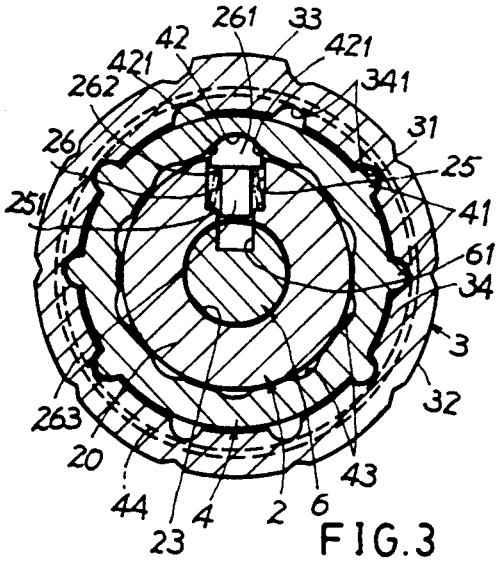
FIG. 3 is a cross sectional drawing of the present invention when viewed from 3—3 direction of FIG. 2.
Figure 4:
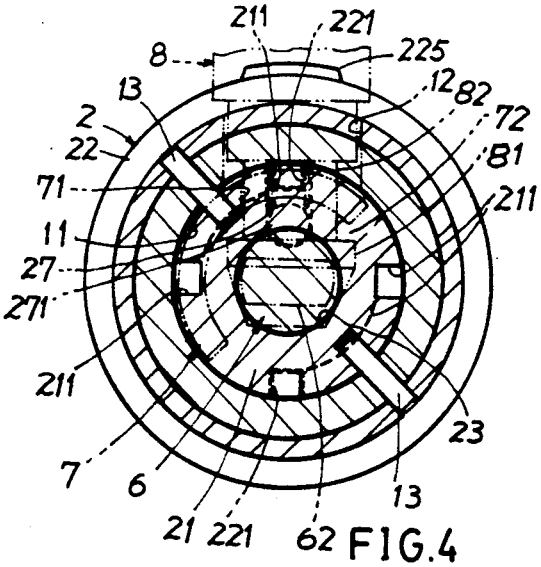
FIG. 4 is a cross sectional drawing of the present invention when viewed from 4—4 direction of FIG. 2.

The inner ring 45 of an innermost sleeve 4 as shown in FIG. 2 is provided to retain the tensioning spring 223 held in the groove 222.

The combination-changing means 5 is generally formed with a circular disk having a central disk hole 50 rotatably engageable with the spindle 21 including a pin slot 52 radially formed in the circular disk communicated with the disk hole 50, and at least a lug 51 formed on a side portion of the circular disk protruded outwardly towards the outer cap 24 having a socket 511 recessed inwardly in the lug 51 which is engageable in the positioning slot 242 of the cap 24.

The rotating knob 6 includes: a bolt 60 protruding inwardly from a knob disk 63 and rotatably engageable with the central hole 23 formed in the hollow spindle, 21 a longitudinal slot 61 formed in the bolt 60 operatively communicated with the pin holes 25 of the lock body 2, a connector 62 formed on an inner end of the bolt 60 for securing the locking member 7, a spring recess 64 formed in the bolt 60 engageable with the positioning ball 271 as shown in FIG. 2, a positioning cam 65 protruding inwardly from the knob disk 63 to be slidably engaged in the arcuate slot 241 formed in the outer cap 24.

The knob disk 63 of the rotating knob 6 includes a marking extension 631 formed on an upper portion of the disk 63 for pointing an openable combination shown on the dials 3, and at least an insertion hole 632 formed through the disk 63 communicated with the socket 511 of the combination-changing means 5. The disk 63 is formed as a cap shape rotatably engageable with and sealably shielding the outer cap 24 of the lock body 2.

The locking member 7 may be formed with an elongate rod or plate having a cross section of secant or meniscus shape, and includes two retaining notches 71 respectively engaging two engaging heads 81 each formed on a lower end of each leg member 80 of the shackle 8, and a hollow portion 72 for movably storing the engaging heads 81 therein.

Each engaging head 81 of the shackle 8 generally formed as a truncated cone shape includes a neck portion 82 annularly formed in the head 81 engageable with the retaining notch 71 of the locking member 7.

Figure 8:
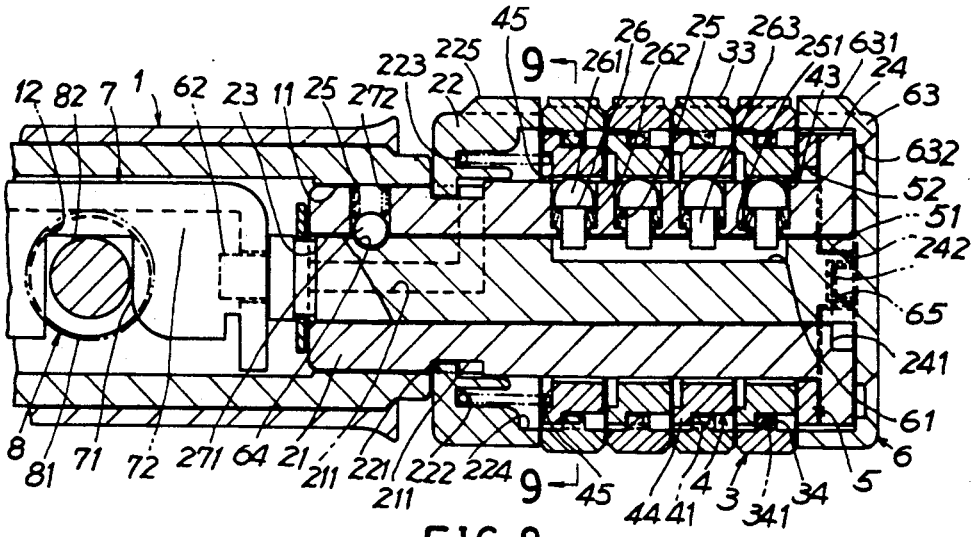
FIG. 8 is an illustration showing a locking state of the present invention.
Figure 9:
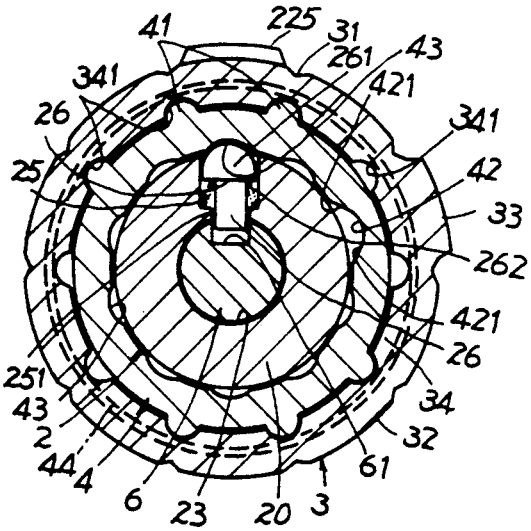
FIG. 9 is a cross sectional drawing of the present invention when viewed from 9—9 direction of FIG. 8.
Figure 10:
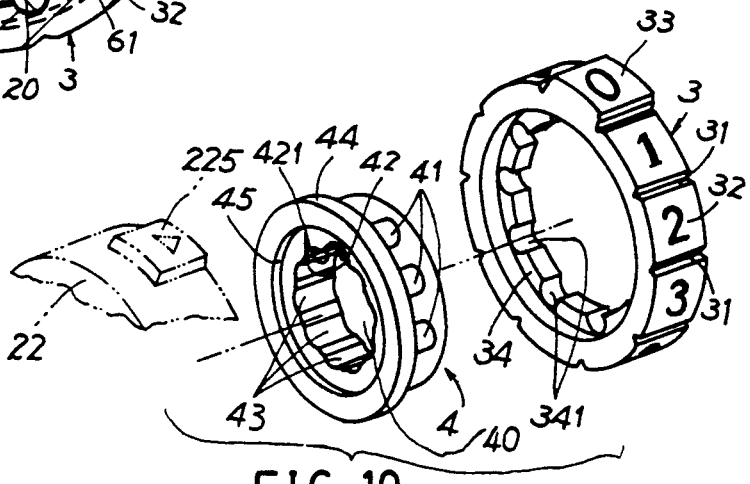
FIG. 10 is a partial perspective view showing a dial and a sleeve of the present invention.

For locking the present invention, the shackle 8 is secured with the cylindrical casing 1 by inserting two engaging heads 81 through the two holes 12, the knob 6 is rotated to rotate the locking member 7 to allow the two notches 71 of the locking member 7 to be engaged with the two engaging heads 81 of the shackle 8 and the dials 3 are rotated to a locking combination to deviate each deep recess 42 of the sleeve 4 from the longitudinal slot 61 of the bolt 60 of the knob 6 to downwardly depress at least a pin 26 in the pin hole 25 to protrude the shank portion 263 downwardly as shown in FIG. 8 as the head portion 260 of the pin 26 is urged downwardly by the shallow recess 43 of the sleeve 4, thereby preventing a rotation of the knob 6 for locking the lock of the present invention.

For opening the present invention by rotating the dials 3 to a pre-determined opening combination, the sleeves 4 are rotated to allow each deep recess 42 to engage the mushroom-shaped head portion 260 of the pin 26 to raise each pin 26 above an interface between the hollow spindle 21 and the bolt 60 as shown in FIG. 2 whereby the bolt 60 is no longer locked by the pins 26 and upon a rotation of the knob disk 63 of knob 6 to rotate the locking member 7 to disengage the notches 71 from the engaging heads 81 of the shackle, thereby unlocking the shackle 8 which can be removed from the casing 1.

The arcuate slot 241 limits an angular rotation of the cam 65 of the knob 6 for limiting the rotation angle of the locking member 7 for ensuring a reliable locking and unlocking operation of the present invention. For re-locking the present invention from an openend condition, a reverse rotation of the knob 6 and locking member 7 will be precisely positioned by resiliently engaging the positioning ball 271 into the recess 64 of the bolt 60 as shown in FIG. 8.

For changing a combination of the present invention when the lock is openend, an additional tool such as a needle or a pin may be inserted through the insertion hole 632 of the knob disk 63, a positioning slot 242 formed in the cap 24 to contact the socket 511 of the disk of the combination-changing means 5 and upon a depression of the needle or pin to depress the disk 5, the sleeves 4 will be depressed inwardly to disengage from the dials 3 which can then be freely rotated for re-setting a new combination. Once releasing the tool or needle, the tensioning spring 223 will restore the sleeves 4 to re-engage the dials 3 ready for locking purpose.

Accordingly, this invention is superior to a conventional combination lock with the following advantages:

1. The knob 6 is rotated to rotate the locking member 7 for unlocking the shackle 8 secured on the casing 1. Once the knob 6 is rotated to an opening combination, the shackle 8 can be quickly removed from the casing 1, thereby providing a convenient unlocking operation more ergonomically.

2. The unlocking operation is effected by an axial rotation of the knob along an axis 1*a* of the casing 1 and the lock body 2, rather than a linear reciprocative movement, so that a total volume of the lock can be minimized beneficial for its handling and storage.

3. The way for changing a new combination of this invention is easier and reliable. The combination changing operation can be performed directly on the lock without dismantling the lock. Any needle or needle-like tool can be inserted into the knob 6 for depressing the sleeves 4 to be disengaged from the dials 3 for changing a new combination so that the combination changing operation is quite easy and convenient.

I claim:

1. A combination lock comprising:

a cylindrical casing having two shackle holes formed therein for lockably inserting two leg members of a shackle generally U-shaped through said two shackle holes;

a lock body having a hollow spindle secured with an open end portion of said casing having a central hole formed through the hollow spindle;

a plurality of dials rotatably engageable with a plurality of sleeves rotatably mounted on said hollow spindle of said lock body;

a rotating knob having a bolt protruding inwardly from a knob disk and rotatably engageable in the central hole of said hollow spindle;

a locking member secured with said bolt of said rotating knob normally locking said two leg members of said shackle;

and means formed in said hollow spindle operatively retarding a rotation of said bolt of said knob;

whereby upon a rotation of said dials and sleeves to a predetermined opening combination to prevent retarding of the rotation of said bolt and upon a rotation of said knob to rotate said bolt and said locking member, said shackle will be unlocked and removable from said casing;

said plurality of dials and sleeves rotatably mounted on said hollow spindle and defined between an inner cap formed on an inner portion of said lock body proximate the open end portion of said casing opposite to a closed end portion of said casing, and an outer cap formed on an outer end portion of said lock body having said knob disk of said knob rotatably encasing said outer cap in said knob disk;

said outer cap of said lock body formed with an arcuate slot communicated with said central hole in said spindle for slidably limiting a cam protruding inwardly from said knob disk when rotating said knob for locking and unlocking said locking member; and said hollow spindle formed with a positioning ball therein having a ball spring resiliently urging the ball to be engageable with a ball recess formed in said bolt of said rotating knob.

2. A combination lock according to claim 1, wherein a combination-changing means generally formed as a circular disk is slidably held on said hollow spindle and operatively depressed inwardly for disengaging said sleeve from said dials upon an insertion of a needle through an insertion hole formed through said knob disk, and through a positioning slot formed in an outer cap of said lock body for contacting said circular disk.

3. A combination lock according to claim 2, wherein said combination-changing means includes at least a side lug formed on a side portion of said circular disk of said combination-changing means having a socket formed in said lug adapted for depression by a needle inserted through the knob disk and the lock body.

* * * * *